US008588649B2

(12) United States Patent
Okabe et al.

(10) Patent No.: US 8,588,649 B2
(45) Date of Patent: Nov. 19, 2013

(54) IMAGE FORMING APPARATUS IN WHICH MOVEMENT OF COVER CAUSES MOVING MECHANISMS TO MOVE EXPOSURE MEMBERS

(75) Inventors: Yasushi Okabe, Nagoya (JP); Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/434,521

(22) Filed: Mar. 29, 2012

(65) Prior Publication Data

US 2012/0189346 A1 Jul. 26, 2012

Related U.S. Application Data

(63) Continuation of application No. 12/413,861, filed on Mar. 30, 2009, now Pat. No. 8,150,294.

(30) Foreign Application Priority Data

Apr. 25, 2008 (JP) ..... 2008-116288
Apr. 25, 2008 (JP) ..... 2008-116289

(51) Int. Cl.
*G03G 15/04* (2006.01)
*G03G 15/00* (2006.01)

(52) U.S. Cl.
USPC ..... 399/118; 399/110

(58) Field of Classification Search
USPC ..... 399/118, 112, 110, 125; 347/138, 152
See application file for complete search history.

(56) References Cited

U.S. PATENT DOCUMENTS 5,291,249 A 3/1994 Lee
5,477,306 A 12/1995 Iguchi et al.
5,808,649 A 9/1998 Shimanari et al.
6,708,011 B2 3/2004 Nomura et al.
7,356,283 B2 4/2008 Igarashi (Continued)

FOREIGN PATENT DOCUMENTS

JP 04-212973 A 8/1992
JP 05-249767 A 9/1993

(Continued)

OTHER PUBLICATIONS

Notification of Reasons for Refusal for corresponding Japanese Patent Application No. 2008-116289 mailed Apr. 20, 2010.

(Continued)

*Primary Examiner* — Sophia S Chen
(74) *Attorney, Agent, or Firm* — Banner & Witcoff, Ltd.

(57) ABSTRACT

An image forming apparatus includes a cover moving between a first position where the cover opens an opening and a second position where the cover closes the opening; photoconductors arrayed in a predetermined direction; and exposure members provided in one to one correspondence with the photoconductors. Each exposure member exposes a corresponding photoconductor and moves between third and fourth positions. The apparatus also includes moving mechanisms provided in one to one correspondence with the exposure members, each moving mechanism moving the corresponding exposure member between the first and second positions; a power transmission mechanism transmitting power from the cover to the moving mechanisms such that movement of the cover from the second position to the first position causes each moving mechanism to move the corresponding exposure member from the third position to the fourth position. Each exposure member tilts when moving from the third position to the fourth position.

20 Claims, 7 Drawing Sheets

(56) References Cited

U.S. PATENT DOCUMENTS

| | | | | |
|---|---|---|---|---|
| 7,444,099 | B2 | 10/2008 | Eguchi | |
| 7,778,567 | B2 | 8/2010 | Igarashi et al. | |
| 8,150,294 | B2 * | 4/2012 | Okabe et al. | 399/118 |
| 2001/0021321 | A1 | 9/2001 | Kikuchi et al. | |
| 2006/0067734 | A1 | 3/2006 | Igarashi et al. | |
| 2007/0047470 | A1 | 3/2007 | Okabe | |
| 2007/0071493 | A1 | 3/2007 | Eguchi | |
| 2007/0122187 | A1 | 5/2007 | Mase | |
| 2009/0058978 | A1 | 3/2009 | Itabashi | |
| 2009/0220250 | A1 | 9/2009 | Funahashi | |

FOREIGN PATENT DOCUMENTS

| | | | |
|---|---|---|---|
| JP | 09-160333 | A | 6/1997 |
| JP | 2000-047458 | A | 2/2000 |
| JP | 2001-166555 | A | 6/2001 |
| JP | 2001-175046 | A | 6/2001 |
| JP | 2001-255803 | A | 9/2001 |
| JP | 2003-015378 | A | 1/2003 |
| JP | 2003-112446 | A | 4/2003 |
| JP | 2006-018127 | A | 1/2006 |
| JP | 2006-098772 | A | 4/2006 |
| JP | 2006-263985 | A | 10/2006 |
| JP | 2007-065125 | A | 3/2007 |
| JP | 2007-066125 | A | 3/2007 |
| JP | 2007-096889 | A | 4/2007 |
| JP | 2007-155793 | A | 6/2007 |
| JP | 2008-090045 | A | 4/2008 |

OTHER PUBLICATIONS

Office Action received for counterpart Japanese Patent Application No. 2008-116288 mailed Jul. 13, 2010.

JP Office Action dtd Dec. 7, 2010, JP Appln. 2010-138738, English Translation.

JP Office Action dtd Feb. 8, 2011, JP Appln. 2010-201699, English Translation.

JP Office Action dtd Sep. 13, 2011, JP Appln. 2010-138738, English Translation.

JP Office Action dtd Jan. 31, 2012, JP Appln. 2011-173637, English Translation.

* cited by examiner

IMAGE FORMING APPARATUS IN WHICH MOVEMENT OF COVER CAUSES MOVING MECHANISMS TO MOVE EXPOSURE MEMBERS

CROSS-REFERENCE TO RELATED APPLICATIONS

This application is a continuation of prior U.S. application Ser. No. 12/413,861, filed Mar. 30, 2009, which is based upon and claims priority from Japanese Patent Application No. 2008-116288 filed on Apr. 25, 2008, and Japanese Patent Application No. 2008-116289 filed on Apr. 25, 2008, the entire contents of which are incorporated herein by reference.

TECHNICAL FIELD

The present invention relates to an image forming apparatus such as a printer of electrophotographic system.

BACKGROUND

An image forming apparatus such as a printer including an LED exposure system is provided.

An example of an image forming apparatus of LED exposure system is described in JP-A-4-212973. The image forming apparatus includes a process cartridge including a photoconductor belt and image exposing means for exposing a peripheral surface of the photoconductor belt. The image forming apparatus has a front surface provided with a door which allows the process cartridge to be mounted to and removed from the image forming apparatus. When the door is opened, the image exposing means moves away from the photoconductor belt and retracts from a mount/removal path of the process cartridge. Specifically, the image exposing means is housed within a guide device such that the image exposing means is movable vertically. When the door is closed, a distal end of the image exposing means is located close to the peripheral surface of the photoconductor belt. In synchronization with the operation for opening the door, the mage exposing means moves downward in the guide device and located at a position retracted from the mount/removal path of the process cartridge.

SUMMARY

In the image forming apparatus, the image exposing means moves linearly in the guide device, which requires a large space for the guide apparatus in the image forming apparatus. That is, it is necessary to provide a space for entirely storing the image exposing means when the image exposing means is retracted from the mount/removal path, on a side where the image exposing means is disposed with respect to the process cartridge. This configuration leads an increase of the size of the image forming apparatus.

The present invention was conceived in consideration of the above-described circumstances, and an object thereof is to provide an image forming apparatus with a reduced space for retracting an exposure member from a photoconductor.

According to an aspect of the invention, there is provided an image forming apparatus comprising: a main body having an opening; a photoconductor unit comprising a photoconductor and removably mountable to the main body through the opening by moving the photoconductor unit in a first direction; an exposure member attached to the main body and configured to expose the photoconductor; and a moving mechanism configured to move the exposure member to and away from the photoconductor in a second direction intersecting the first direction, wherein the moving mechanism comprises: a fixed shaft having an axial line thereof fixed relative to the main body; a first arm comprising one end portion thereof which is supported rotatably around the axial line of the fixed shaft; a movable shaft having an axial line thereof which is movable relative to the main body; and a second arm comprising: one end portion supporting the exposure member; and another end portion connected to the first arm via the movable shaft, and the second arm being swingable around the axial line of the movable shaft.

According to another aspect of the invention, there is provided an image forming apparatus comprising: a main body; a photoconductor provided in the main body; an exposure unit provided in the main body and comprising a exposure head configured to expose the photoconductor, the exposure unit being movable between an exposure posture in which the exposure head opposes the photoconductor and a retracted posture in which the exposure head is retracted from the photoconductor; a reading unit configured to read an image formed on a document; a supporting member provided between the main body and the reading unit and supporting the reading unit; wherein a part of the exposure unit is stored in the supporting member.

DESCRIPTION

Hereinafter, a description will be given of exemplary embodiments of the present invention with reference to the drawings.

1. Overall Configuration of Printer

Figure 1:
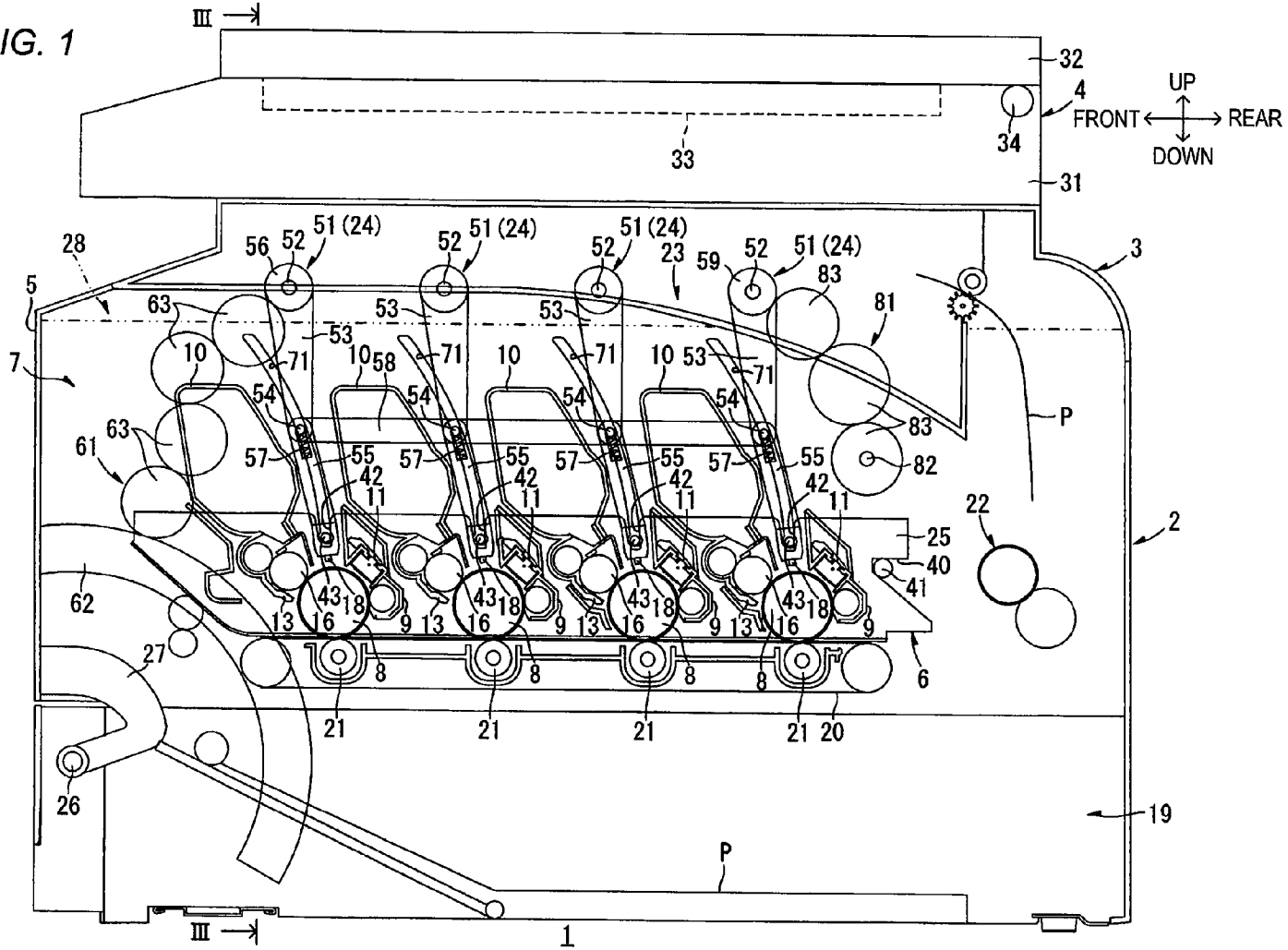
FIG. 1 is a side sectional view illustrating a printer as an example of an image forming apparatus according to a first exemplary embodiment.

FIG. 1 is a side sectional view illustrating a printer as an example of an image forming apparatus according to a first exemplary embodiment.

A printer 1 is a multi function device, which includes: a substantially box-shaped main body 2; a supporting 3; and a flat bed scanner 4 supported by the supporting member 3 on the main body 2. The flat bed scanner 4 serves as an example of a reading unit.

(1) Main Body

In the main body 2, a drum unit 6 as an example of a photoconductor unit is mounted. The drum unit 6 includes four photoconductor drums 8 for respective four colors, black, yellow, magenta and cyan. The photoconductor drum 8 serves as an example of a photoconductor. The four color photoconductor drums 8 are arranged along a conveying direction of a sheet P conveyed by a conveying belt 20 with constant intervals. The drum unit 6 further includes drum subunits 9 and developer cartridges 10 for the respective photoconductor drums 8. The developer cartridge 10 serves as an example of a developing member.

In the main body 2, LED units 24 are provided for the respective photoconductor drum 8. The LED unit 24 serves as an example of an exposure unit.

As the photoconductor drum 8 rotates, an outer peripheral surface of the photoconductor drum 8 is constantly charged by a scorotron charger 11 provided in the drum subunit 9. Thereafter, the surface of the photoconductor drum 8 is selectively exposed by light emitted from LED unit 24. The exposure forms an electrostatic latent image based on image data on the surface of the photoconductor drum 8. When the electrostatic latent image opposes a developing roller 16 provided in the developer cartridge 10 in accordance with the rotation of the photoconductor drum 8, toner is supplied from the developing roller 16 to the electrostatic latent image, which visualizes the electrostatic latent image by the toner. Accordingly, a toner image is formed on the surface of the photoconductor drum 8.

In a lower portion of the main body 2, a sheet feed cassette 19 configured to store the sheet P is provided. The sheet P stored in the sheet feed cassette 19 is fed and conveyed to the conveying belt 20 by various rollers. The conveying belt 20 is disposed to oppose the four photoconductor drums 8 from below. Transfer rollers 21 are provided at positions opposing the respective photoconductor drums 8 across an upper portion of the conveying belt 20. The sheet P conveyed on the conveying belt 20 passes through between the conveying belt 20 and the photoconductor drums 8 in order by a running of the conveying belt. When the toner image formed on the surface of the photoconductor drum 8 opposes the sheet P, the toner image is transferred to the sheet P by a transfer bias applied to the transfer roller 21.

A fixing unit 22 is provided on a downstream side of the conveying belt 20 in the conveying direction of the sheet P. The sheet P having the toner image transferred thereon is conveyed to the fixing unit 22. The fixing unit 22 heats and pressurizes the toner image so as to fix the toner image on the sheet P. The sheet P having the toner image fixed thereon is discharged to a discharge tray 23 provided on an upper surface of a casing of the main body 2 via various rollers.

Hereinafter, with respect to the conveying direction of the sheet P conveyed by the conveying belt 20, an upstream side is referred to as a front side, and an opposite side thereof is referred to as a rear side. Left and right sides are defined when the printer 1 viewed from the front side.

(2) Supporting Member

Figure 3:
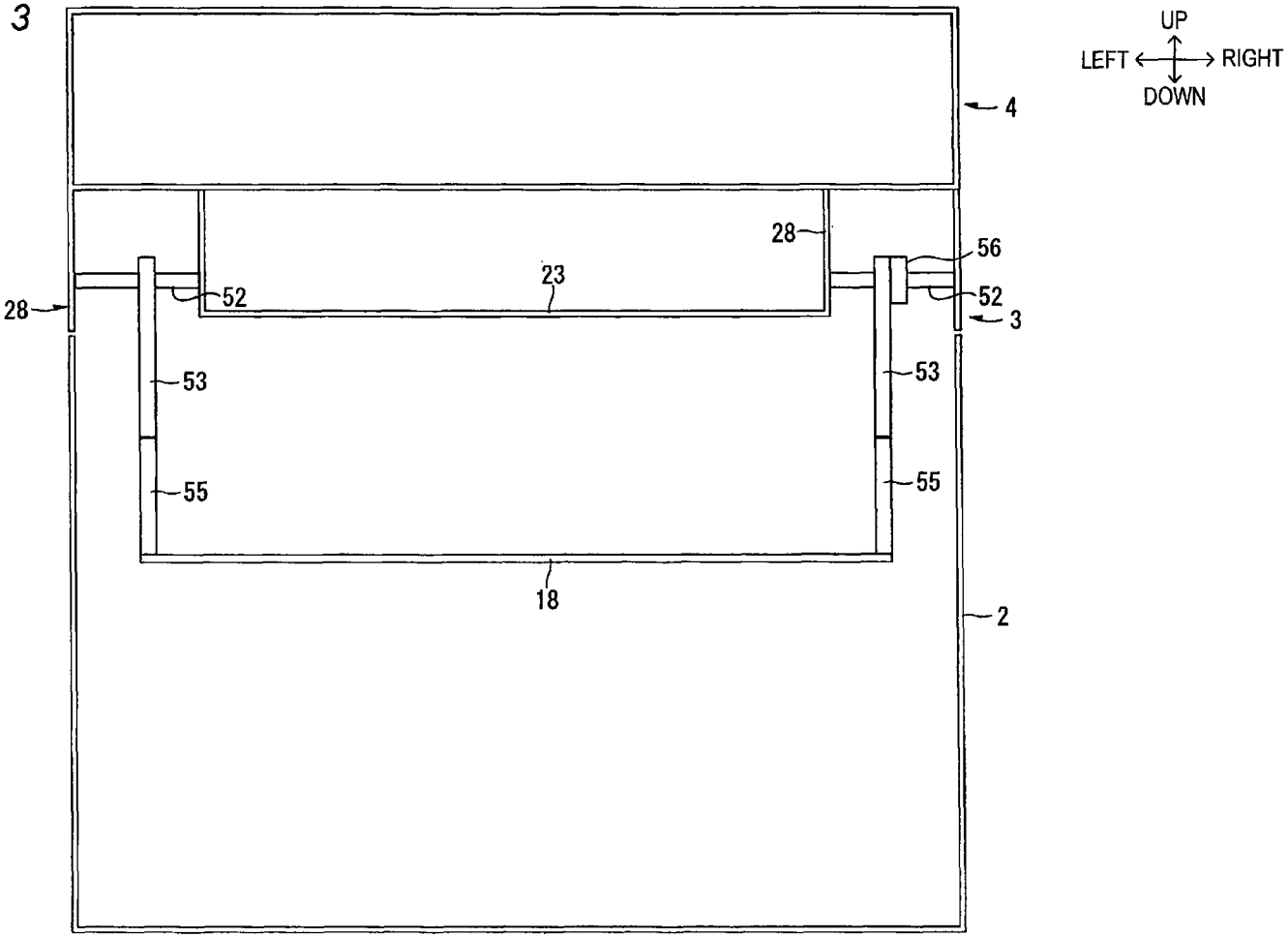
FIG. 3 is a side cross-sectional view of the printer taken along a line III-III in FIG. 1.

FIG. 3 is a side cross-sectional view of the printer taken along a line III-III in FIG. 1.

As shown in FIG. 3, the supporting member 3 is located on and integrally provided with the main body 2. The supporting member 3 includes a pair of leg portions 28. The leg portions 28 opposes each other in the left and right directions, and each of the leg portions 28 extends in the front and rear directions. Lower end portions of the leg portions 28 are connected to each other by the discharge tray 23. FIG. 1 shows the leg portions 28 by an imaginary line. Hereinafter, the leg portion 28 provided on a left side is referred to as a left leg portion 28, and the leg portion 28 provided on a right side is referred to as a right leg portion 28.

Each of the leg portions 28 is opened downward, and an inner space of each of the leg portion 28 is used as a storage space in which at least a part of the LED unit 24 is stored.

(3) Flat Bed Scanner

The flat bed scanner 4 includes: a document table 31 fixed to the supporting member 3; and a cover 32 swingably supported by the document table 31 via a hinge 34.

The document table 31 has a substantially rectangular shape in a plan view. A platen glass 33 is provided on an upper surface of the document table 31, and a document can be placed on the platen glass 33. The flat bed scanner 4 further includes a CCD sensor (not shown) provided within the document table 31 and below the platen glass 33 so as to read an image formed on the document placed on the platen glass 33.

2. Front Cover

Figure 2:
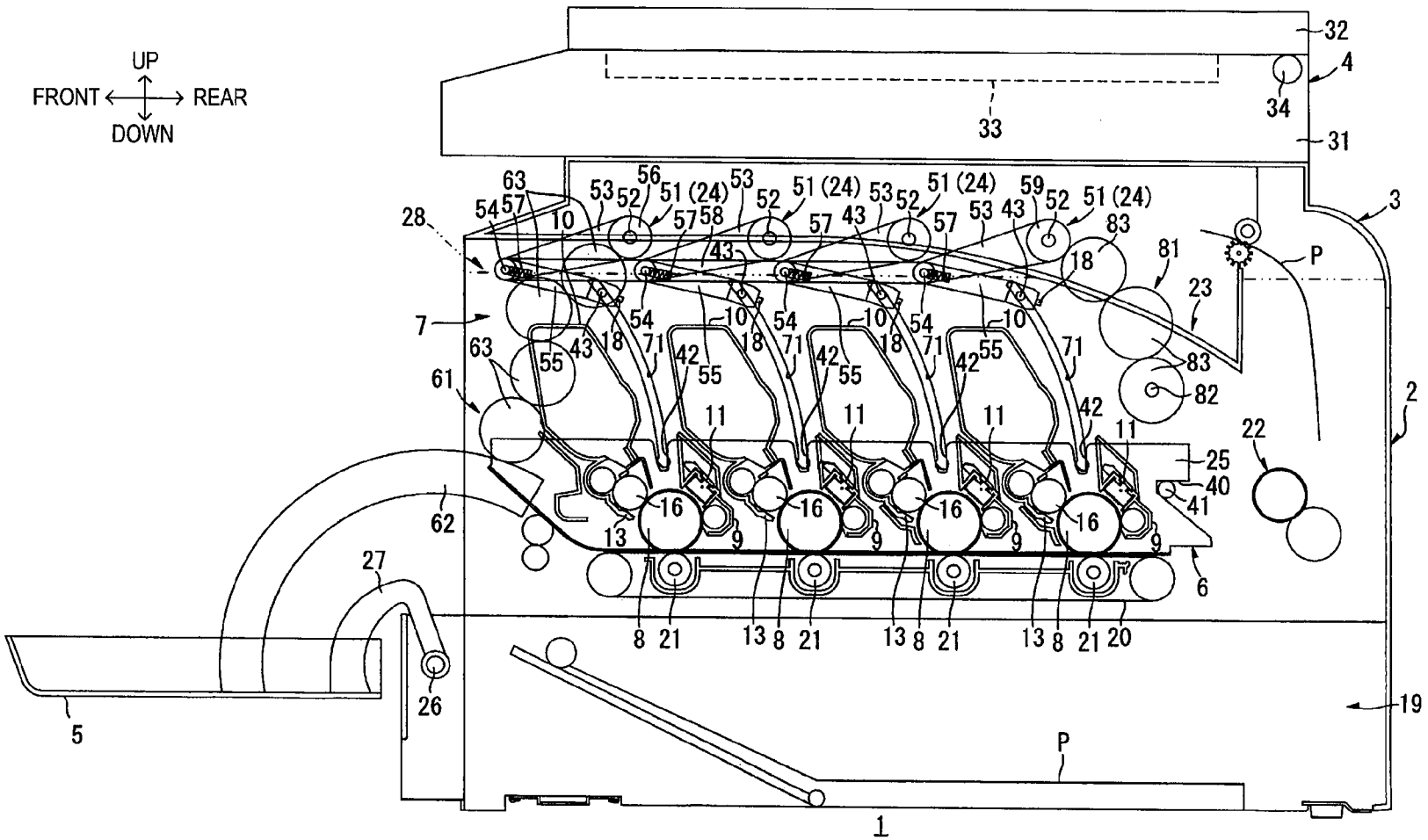
FIG. 2 is a side sectional view of the printer shown in FIG. 1 in a state in which a cover is opened.

FIG. 2 is a side sectional view of the printer shown in FIG. 1 in a state in which a cover is opened.

The main body 2 has an opening 7 formed in a front surface of the main body 2. A front cover 5 is provided on the front surface of the main body 2 and configured to open and close the opening 7. The front cover 5 serves as an example of a cover. Specifically, a cover shaft 26 and a cover arm 27 are provided to open and close the front cover 5. The cover shaft 26 is provided at a front end portion of the main body 2 and below the opening 7 and extends in the left and right directions. The cover arm 27 has a substantially U-shape in side view. One end of the cover arm 27 is rotatably supported by the cover shaft 26, and another end of the cover arm 27 is fixed to an inner surface of a lower end portion of the front cover 5. Consequently, the front cover 5 is supported by the cover arm 27 and rotatable together with the cover arm 27 around the cover shaft 26. The front cover 5 closes the opening 7 during a standing state (a state shown in FIG. 1) along the front surface of the main body 2, and opens the opening 7 the main body 2 during a falling state frontward (a state shown in FIG. 2).

3. Drum Unit

The drum unit 6 can be mounted to and removed from the main body 2 by sliding the drum unit 6 in the front and rear directions through the opening 7 in a state in which the opening 7 is opened. That is, the drum unit 6 can be mounted to the main body 2 by opening the opening 7 and pushing the drum unit 6 toward the inside of the main body 2 (i.e., rearward). Further, the drum unit 6 can be removed from the main body by opening the opening 7 and pulling the drum unit 6 frontward from the inside of the main body 2.

The drum unit 6 includes a pair of side plates 25. The side plates 25 sandwich the four the photoconductor drums 8, the four drum subunits 9 and the four developer cartridges 10 from the left and right sides. Hereinafter, the side plate 25 provided on the left side is referred to as a left side plate, and the side plate provided on the right side is referred to as a right side plate. The side plate 25 has a substantially rectangular shape having longer sides extending in the front and rear directions in side view. The side plates 25 has a notch portion 40 having a substantially V-shape in side view formed at a rear end portion of the side plate 25. When the drum unit 6 is mounted to the main body 2, a reference shaft 41 provided at a rear end portion of the main body 2 so as to extend in the left and right directions is fitted to the notch portion 40, which positions the drum unit 6 to the main body 2. The side plate 25 has four positioning grooves 42 formed at an upper end portion thereof and arranged along the front and rear directions with certain intervals. Each of the positioning grooves 42 corresponds to a respective one of the photoconductor drums 8, and is formed by cut out the side plate 25 substantially linear from an upper end of the side plate 25 toward a rotation center of the respective one of the photoconductor drums 8.

The four photoconductor drums 8 are arranged along the front and rear directions with certain intervals between the left and right side plates 25. Each of the photoconductor drum 8 extends in the left and right directions, and both end portions thereof are rotatably held by the left and right side plates 25. Each of the drum subunits 9 is disposed on a rear side of a respective one of the photoconductor drum 8. Each of the drum subunit 9 extends in the left and right directions, and both end portions thereof are fixed to the left and right side plates 25.

The four developer cartridges 10 are removably mounted between the left and right side plates 25 and on a front side of the respective photoconductor drums 8. Each of the developer cartridges 10 includes a casing having a box shape with an opening formed in one end portion of the casing 13. In the one end portion of the casing 13, the developing roller 16 is rotatably held such that a part of a peripheral surface of the developing roller 16 is exposed. The developer cartridge 10 is mounted between the pair of side plates 25 from an upper front side of the corresponding photoconductor drum 8 such that the peripheral surface of the developing roller 16 contacts the peripheral surface of the photoconductor drum 8. In this mounted state, the casing 13 extends in the upper and lower directions and largely protrudes upward from the upper end of the side plates 25. An upper end portion of the casing 13 (a portion protruding upward from the upper end of the side plate 25) has a substantially rectangular parallelepiped shape with a rear surface slightly concaved frontward. Consequently, the casing 13 has an outer shape which does not enter (is separated from) a moving path of a LED head 18 guided by guide portions 71.

In the drawings, the side plate 25 is illustrated by an outline thereof only, and elements such as the photoconductor drum 8 and the developing roller 16 are illustrated through the side plate 25.

4. LED Unit

The four LED units 24 are provided so as to correspond to the respective photoconductor drums 8 and arranged in parallel with one another along the front and rear directions. Each of the LED units 24 includes: the LED head 18 serving as an example of an exposure head (exposure member) configured to expose the surface of the photoconductor drum 8; and a pair of moving mechanisms 51 each provided in the left side and the right side configured to move the LED head 18 to and away from the photoconductor drum 8. Hereinafter, the moving mechanism 51 provided on the left side is referred to as a left moving mechanism, and the moving mechanism 51 provided on the right side is referred to as a right moving mechanism.

In the drawings (e.g., FIG. 1), elements such as the discharge tray 23 are illustrated through the LED unit 24.

(1) LED Head

The LED head 18 includes a LED array (not shown) provided therein which includes the number of LEDs arrayed along the left and right directions. Positioning bosses 43 are provided at a left end portion and a right end portion of the LED head 18, respectively, and protrude outwards from the respective end portions. Hereinafter, the positioning boss 43 provided on the left end portion is referred to as a left positioning boss, and the positioning boss 43 provided on the right end portion is referred to as a right positioning boss.

Distal ends of the right and left positioning bosses 43 are fitted to the respective groove-shaped guide portions 71 formed in the left and right side walls of the main body 2, respectively. Hereinafter, the guide portions 71 formed on the left side wall is referred to as left guide portions, and the guide portions 71 formed on the right side wall is referred to as right guide portions. A number of the guide portions 71 formed in each of the left and right side walls is four so as to correspond to the respective positioning grooves 42. Each of the guide portions 71 has a gentle arc shape having a lower end potion overlapping with the respective one of positioning grooves 42 in side view and extending toward upper front direction with convex rearward.

(2) Moving Mechanism

The left and right moving mechanisms 51 are connected to left and right end portions of the LED head 18, respectively. Each of the moving mechanisms 51 includes four fixed shafts 52, four first arms 53, four movable shafts 54 and four second arms 55, which correspond to the respective photoconductors 8.

The fixed shafts 52 of the left and right moving mechanisms 51 are provided in the left and right leg portions 28 of the supporting member 3, respectively. Each pair of the left and right fixed shafts 52 is located on a common fixed axial line extending in the left and right directions. The four LED units 24 are arranged in parallel with one another along the front and rear directions. Therefore, the four fixed shafts 52 are arranged in parallel with one another along the front and rear directions with constant intervals in each of the right and left leg portions 28.

In the right leg portion 28, a frontmost right fixed shaft 52 provided in the right transmission mechanism 51 and located at a most front side of the right fixed shafts 52 rotatably supports the an input gear 56 fixed to one end portion of the first arm 53. Further, in the left and right leg portions 28, the rearmost left and right fixed shafts 52, which are located at most rear side of the fixed shafts 52 of the respective left and right fixed shafts 52, supports a transmission gear 59 fixed to one end portions of the rearmost left and right first arms 53.

The first arm 53 has an elongated rod shape. The one end portion (base end portion) of the first arm 53 is rotatably supported by the fixed shaft 52. Consequently, the first arm 53 is swingable around an axial line of the fixed shaft 52.

The movable shaft 54 has an axial line extending in the left and right directions, and non-rotatably provided at a distal end portion of the first arm 53 (end portion opposite to the end portion supported by the fixed shaft 52). Consequently, when the first arm 53 swings, the movable shaft 54 can move on an arc-shaped locus around the axial line of the fixed shaft 52.

The second arm 55 has a rod shape which is slightly shorter than the first arm 53. The second arm 55 has a base end portion rotatably supported by the movable shaft 54. Specifically, an opening portion is formed in the base end of the second arm 55 so as to extend in a longitudinal direction of the second arm 55, and the movable shaft 54 is rotatably inserted in the opening portion. Therefore, the second arm 55 is swingable around the axial line of the movable shaft 54. The LED head 18 is supported between distal end portions of the second arms 55 of the right and left moving mechanisms 51 such that the LED head 18 extends along the left and right directions.

In the opening portion formed in the base end portion of the second arm 55, a coil spring 57 is provided. The coil spring 57 serves as an example of an urging member. One end of the coil spring 57 is fixed to the movable shaft 54, and the other end of the coil spring 57 is fixed to a distal end of the opening portion. That is, the coil spring 57 is provided between the movable shaft 54 and the distal end of the opening portion. The coil spring 57 has an urging force to urge the distal end portion of the second arm 55 in a direction away from the movable shaft 54.

In each of the right and left sides of the four LED units 24, the four movable shafts 54 arranged in the front and rear directions rotatably penetrate a connection member 58 extending in the front and rear directions and having an elongated plate shape in side view. Consequently, the connection member 58 connects the four movable shafts 54. Therefore, the four movable shafts 54 connected by the connection member 58 are maintained in parallel with one another, and each of the four movable shafts 54 can move on an arc-shaped locus around the axial line of the respective one of the fixed shafts 52.

5. Power Transmission Mechanism

A power transmission mechanism 61 is provided between the front cover 5 and the input gear 56 and configured to transmit power to the input gear 56 to operate the moving mechanism 51 in synchronism with open and close operations of the front cover 5.

The power transmission mechanism 61 includes: a rack gear 62; and an even number of gears 63 (four gears in this embodiment) provided between the rack gear 62 and the input gear 56.

The rack gear 62 has an arc shape in side view which is substantially quarter of a circle around the cover shaft 26 as a swing axis, and includes a plurality of gear teeth on a peripheral surface of the rack gear 62. One end of the rack gear 62 is fixed to a center portion of the inner surface of the front cover 5 in the upper and lower directions.

The gears 63 (the even number of the gears 63) mesh with each other and configure a gear train. The gear 63 located at one end of the gear train meshes with the rack gear 62. The gear located at the other end of the gear train meshes with the input gear 56.

In the drawings such as FIG. 1, the rack gear 62 is illustrated by an outline thereof only, and the elements such as the side plate 25 are illustrated through the rack gear 62.

6. Synchronism Mechanism

A Synchronism mechanism 81 is provided between the left and right transmission gears 59 and configured to synchronize the movement of rearmost moving mechanisms 51 of the respective left and right moving mechanisms 51.

The synchronism mechanism 81 includes two sets of an odd number of gears 83 (three gears 83 in this embodiment) which are rotatably supported by left and right side walls of the main body 2, respectively. The two sets of the odd number of gears 83 configure gear trains, respectively, and the gear trains are symmetric with respect to the left and right directions. The gears 83 located at one ends of the respective gear trains mesh with the respective left and right transmission gears 59. The synchronism mechanism 81 further includes a connection shaft 82 which connects rotation shafts of gears 83 which are located at the other ends of the respective gear trains.

When the right transmission gear 59 rotates, the rotation of the right transmission gear 59 is transmitted to the left transmission gear 59 by the synchronism mechanism 81. Consequently, the left transmission gear 59 rotates in the same direction as the right transmission gear 59 in side view.

7. Movement of the LED Head

As shown in FIG. 1, when the front cover 5 closes the opening 7, each of the LED units 24 is positioned in an exposure posture. In the exposure posture, each of the LED units 24 is located on a rear side of a respective one of developer cartridges 10 and overlaps with the respective one of developer cartridges 10 in the front and rear directions. Specifically, in each of the LED units 24, the first arm 53 and the second arm 55 are substantially linearly elongated (stretched) between the fixed shaft 52 and the photoconductor drum 8. Accordingly, the LED head 18 is positioned above and closest to the photoconductor drum 8, and opposes the photoconductor drum 8. The distal ends of the left and right positioning bosses 43 of each of the LED head 18 are positioned at a lower end of the respective guide portions 71, and portions of the respective positioning bosses 43 inside the respective distal ends in the left and right directions are fitted to the respective positioning grooves 42 of the side plates 25. Further, the positioning bosses 43 are pressed to lower ends of the respective positioning grooves 42 by the urging force of the coil spring 57. Accordingly, the four the LED heads 18 are positioned at certain positions relative to the respective photoconductor drums 8, and can properly expose the surfaces of the respective photoconductor drums 8.

When the front cover 5 is opened, the rack gear 62 moves frontward around the cover shaft 26 (swing shaft) in response to the operation of opening the front cover 5. The movement of the rack gear 62 is transmitted to the input gear 56 via the gear train formed by the gears 63. Accordingly, the input gear 56 rotates clockwise in the drawings, and the frontmost right first arm 53 fixed to the input gear 56 rotates clockwise in the drawings around the fixed shaft 52. Consequently, the frontmost right movable shaft 54 provided at the distal end of the frontmost right first arm 53 (i.e., one of the movable shafts 54 which is located on the right side and at most front side of the movable shafts 54) moves in a front and upper direction. Since the four right movable shafts 54 are connected by the connection member 58, in synchronism of the movement of the frontmost right movable shaft 54, the connection member 58 moves in the front and upper direction, and the remaining three right movable shafts 54 move in the front and upper direction. As a result, the four right first arms 53 rotate in synchronism with one another such that the distal ends of the first arms 53 rise in the front and upper direction.

Further, in synchronism with the rotation of the four first arms 53, the right transmission gear 59, which is fixed to the rearmost right first arm 53 located on the right side and most rear side, rotates clockwise in the drawings. The rotation of the right transmission gear 59 is transmitted to the left transmission gear 59 by the synchronism mechanism 81. Accordingly, the left transmission gear 59 rotates clockwise in the drawings, and the rearmost left first arm 53 fixed to the left transmission gear 59 rotates clockwise in the drawings around the fixed shaft 52. Consequently, the movable shaft 54 provided at the distal end of the rearmost left first arm 53 (the movable shaft 54 located on the left side and the most rear side) moves in the front and upper direction. Since the four left movable shaft 54 are connected by the left connection member 58, in synchronism with the movement of the rearmost left movable shaft 54 located on the left side most rear position, the remaining three left movable shaft 54 moves in the front and upper direction. As a result, the four left first arm 53 rotate in synchronism with one another such that the distal ends of the left first arms 53 rise in the front and upper direction.

That is, when the front cover 5 is opened, in synchronism with the operation for opening the front cover 5, all the first arms 53 rotate at the same time, and the movable shafts 54 move in the front and upper direction at the same time.

Each of the movable shafts 54 moves in the front and upper direction, which raises each of the second arms 55 upward. In response to this movement of the second arms 55, the LED heads 18 move upward. Since the positioning bosses 43 of the respective LED heads 18 are fitted to the respective guide portions 71, the positioning bosses 43 are guided by the respective guide portions 71, and the LED heads 18 move upward along the respective guide portions 71. Accordingly, the movable shafts 54 move in the front and upper direction, and the LED heads 18 move upward along the respective guide portions 71. Therefore, the first arm 53 and the second arm 55 are folded (bent) in a V-shape such that the distal ends of the second arms 55 (i.e., the LED heads 18) face rearward.

As shown in FIG. 2, when the front cover 5 is completely opened, each of the LED units 24 is positioned in the retracted posture. In the retracted posture, the positioning bosses 43 of each of the LED heads 18 are positioned at the upper ends of the respective guide portions 71, and each of the LED heads 18 is most retracted from the photoconductor drum 8. Accordingly, LED units 24 are positioned above the respective developer cartridges 10, and separated from a mount/removal path of the drum unit 6. Further, in each of the left and right moving mechanisms 51, the first arm 53 and the second arm 55 are folded so as to form an acutest angle therebetween during a range from the exposure posture to the retracted posture, and a part of the first arm 53 and the second arm 55 are stored within the respective one of left and right leg portions 28.

Since the LED units 24 are separated from the mount/removal path of the drum unit 6, the drum unit 6 can be mounted and removed from the main body 2 without interfering with the LED units 24.

8. Advantages

As described above, in the main body 2, the photoconductor drum 8 is provided. Further, the LED unit 24 is provided in the main body 2 and includes the LED head 18 configured to expose the photoconductor drum 8. The LED unit 24 can take the postures between the exposure posture and the retracted posture. In the exposure posture, the LED head 18 opposes the photoconductor drum 8. In the retracted posture, the LED head 18 is retracted from the photoconductor drum 8. The printer 1 includes the flat bed scanner 4 configured to read the image formed on the document. The supporting member 3 supporting the flat bed scanner 4 is provided between the flat bed scanner 4 and the main body 2. At least a part of the LED unit 24 is stored within the supporting member 3. Accordingly, it is not necessary to provide a space in the main body 2 for the portion of the LED unit 24 which is stored within the supporting member 3. Therefore, for this space, it is possible to reduce a space in the main body 2 required for retracting the LED head 18 from the photoconductor drum 8.

The drum unit 6 is mounted to the main body 2. The drum unit 6 can be mounted to and removed from the main body 2 through the opening 7 formed in the main body 2. Accordingly, in a structure which allows the drum unit 6 to be mounted to and removed from the main body 2, it is possible to reduce the space in the main body 2 required for retracting the LED head 18 from the photoconductor drum 8.

In the main body 2, the moving mechanism 51 is provided. The moving mechanism 51 allows the LED head 18 to move to and away from the photoconductor drum 8 in a direction intersecting a direction of mounting/removing the drum unit 6 with respect to the main body 2.

The main body 2 includes the front cover 5 configured to open and close the opening 7. The front cover 5 and the moving mechanism 51 are connected by the power transmission mechanism 61. The power transmission mechanism 61 transmits to the moving mechanism 51 the power for retracting the LED head 18 from the photoconductor drum 8 in response to the operation of opening the front cover 5. Accordingly, in response to the open of the front cover 5, the LED head 18 can retracted from the photoconductor drum 8.

The moving mechanism 51 includes: the fixed shaft 52 having an axial line fixed with respect to the main body 2; the first arm having one end portion supported rotatably around the axial line of the fixed shaft 52; the movable shaft 54 having an axial line thereof movable with respect to the main body 2; and the second arm 55 having one end portion thereof holding the LED head 18 and the other end portion thereof linked to the one end of the first arm 53 via the movable shaft 54, and the second arm being swingable around the axial line of the movable shaft 54. Accordingly, the first arm 53 and the second arm 55 can be stretched and bent such that the one end portion of the second arm 55 relatively moves to and away from the first arm 53. By moving the one end portion of the second arm 55 toward the first arm 53 along with moving the movable shaft 54, it is possible to retract the LED head held 18 by the one end portion of the second arm 55 from the photoconductor drum 8. As a result, it is only necessary to provide a space in the main body 2 on a side of a direction intersecting the mount/removal direction of the drum unit 6 (e.g., on the upper side) the second arm 55, which can store a portion of the LED unit 24 not stored in the supporting member 3 when the one end of the second arm 55 is close to the first arm 53. Therefore, it is possible to further reduce the space for retracting the LED head 18 from the photoconductor drum 8. Further, the one end portion of the second arm 55 faces a separation direction away from the opening 7 (e.g., the rear direction) when the LED unit 24 is in the retracted posture. Therefore, the LED head 18 is not exposed toward the opening 7 of the main body 2, which can prevent damage to and an adhesion of the dust to the LED head 18.

When the LED unit 24 changes its posture from the exposure posture to the retracted posture, the movable shaft 54 moves in an direction opposite to the separation direction (e.g., in the front side direction). Accordingly, when the LED head 18 is refracted from the photoconductor drum 8, the one end portion of the second arm 55 faces toward the separation direction (e.g., the rear side direction), and the other end portion of the second arm 55 is located in the direction opposite to the separation direction (e.g., front side direction).

In the main body 2, the substantially arc-shaped guide portion 71 is provided. The LED head 18 moves by being guided by the guide portion 71. The drum unit 6 includes the developer cartridge for supplying the toner to the photoconductor drum 8. The developer cartridge 10 has an outer shape which does not enter the moving path of a LED head 18 guided by a guide portion 71. Accordingly, when the LED head 18 moves by being guided by the substantially arc-shaped guide portion 71, it is possible to prevent the LED head 18 from contacting the developer cartridge 10.

The printer 1 further includes the coil spring 57 configured to urge the LED head 18 toward the photoconductor drum 8. Consequently, the LED head 18 is positioned at a position capable of exposing the photoconductor drum 8 by receiving the urging force of the coil spring 57.

The coil spring 57 is provided between the first arm 53 and the second arm 55. Consequently, the second arm 55 can be urged toward the photoconductor drum 8, and the LED head 18 attached to the one end portion of the second arm 55 can be positioned at a position capable of exposing the photoconductor drum 8.

The other end portion of the second arm 55 is supported swingably with respect to the movable shaft 54. The coil spring 57 is provided between the movable shaft 54 and the second arm 55. Accordingly, the second arm 55 can be urged toward the photoconductor drum 8, and the LED head 18 attached to the one end portion of the second arm 55 can be positioned at a position capable of exposing the photoconductor drum 8.

9. Second Exemplary Embodiment

Figure 4:
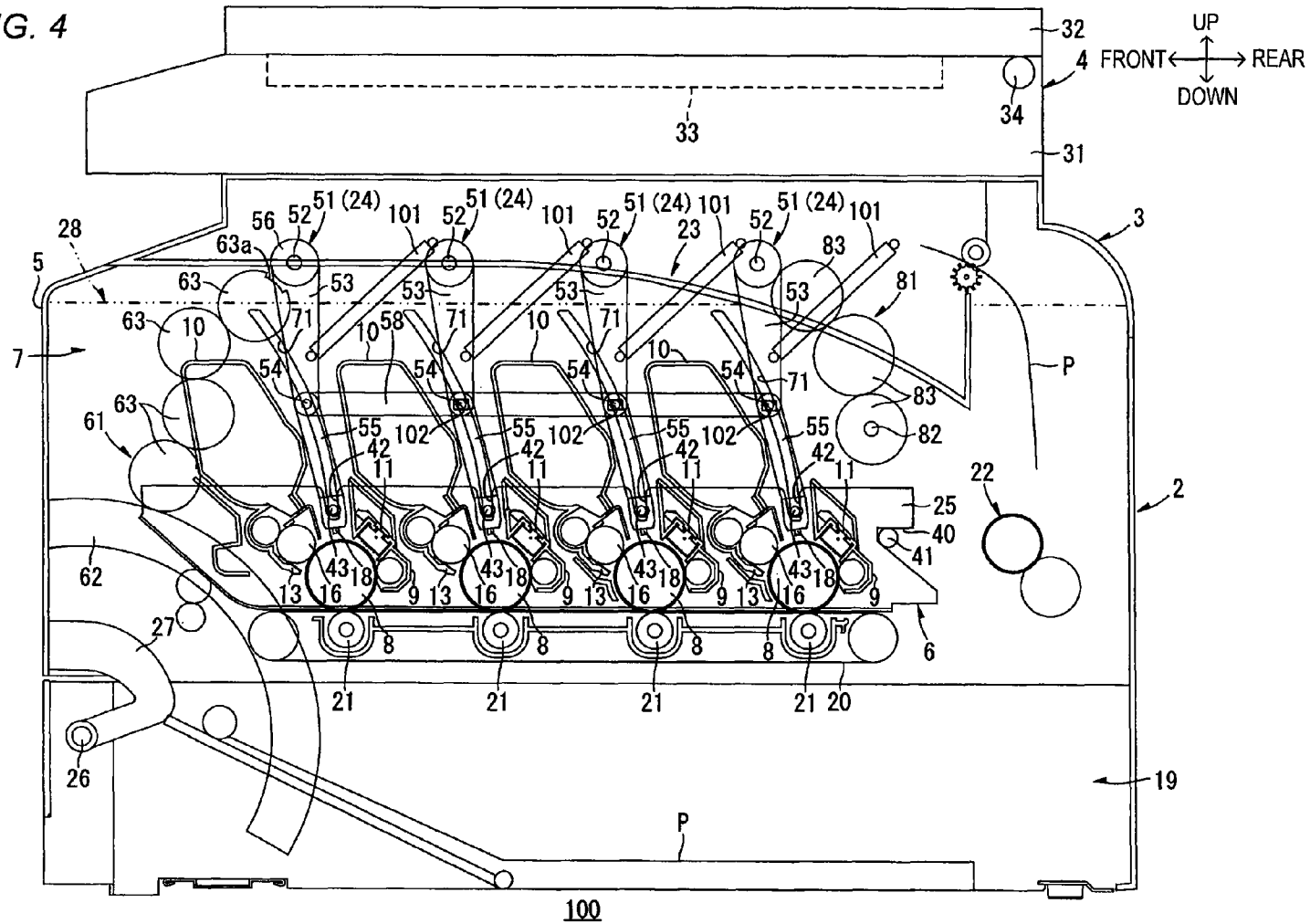
FIG. 4 is a side sectional view illustrating a printer according to a second exemplary embodiment.
Figure 5:
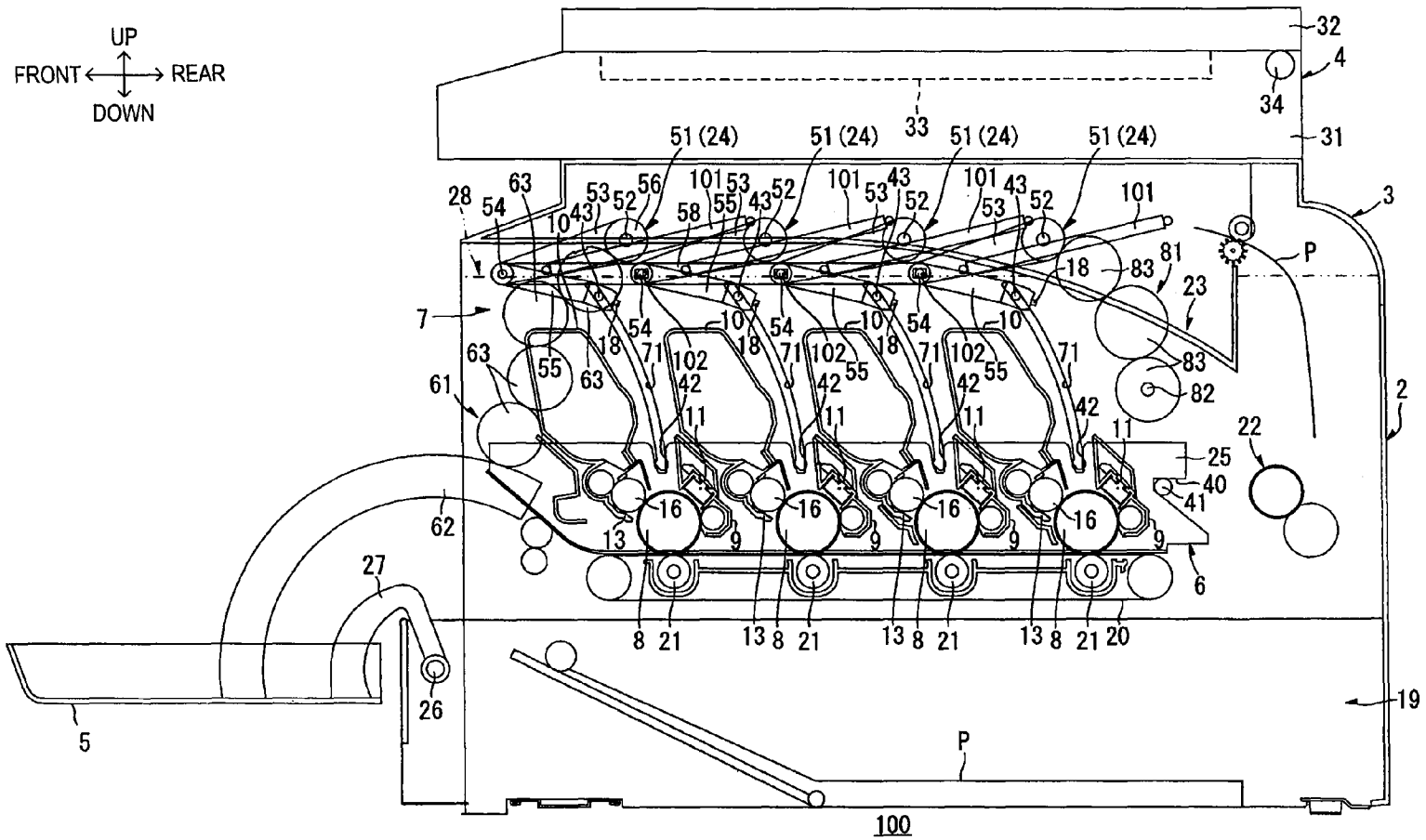
FIG. 5 is a side sectional view of the printer shown in FIG. 4 in a state in which a cover is opened.

FIG. 4 is a side sectional view illustrating a printer according to a second exemplary embodiment, and FIG. 5 is a side sectional view of the printer shown in FIG. 4 in a state in which a cover is opened. In FIG. 4 and FIG. 5, similar or identical elements in connection with FIG. 1 and FIG. 2 are denoted by identical reference symbols. Further, the following description relating to FIG. 4 and FIG. 5 is given around a different configuration than that of FIG. 1 and FIG. 2, and the description in connection with the similar and identical elements is omitted.

In the printer illustrated in FIG. 1 and FIG. 2, the coil spring 57 is provided between the movable shaft 54 and the second arm 55. On the other hand, in the printer 100 illustrated in FIG. 4 and FIG. 5, the coil spring 57 is omitted, and coil springs 101 are provided such that each of the coil springs 101 is provided between a midway portion of the respective one of the first arm 53 in its longitudinal direction and the respective one of the leg portions 28 of the supporting member 3. The coil spring 101 serves as an example of the urging member.

The gear 63 meshing with the input gear 56 is a partially toothless gear in which a part of the peripheral surface of the gear 63 has a toothless portion 63*a* which do not include any teeth. The input gear 56 serves as an example of the first gear, and the gear 63 serves as an example of the second gear. When the front cover 5 is closed and the LED unit 24 takes the exposure posture, the toothless portion 63*a* of the gear 63 opposes the input gear 56, and meshing of the gear 63 and the input gear 56 is released. When the gear 63 rotates from this state, the gear 63 meshes with the input gear 56, and the input gear 56 rotates as the gear 63 rotates.

Each of the left and right connection members 58 has substantially rectangular through holes 102 having longer sides in the front and rear directions. The movable shafts 54, except for the movable shaft 54 at the distal end of the first arm 53 fixed to the input gear 56, are inserted in the respective through holes 102.

Accordingly, when the LED units 24 are in the exposure posture, the first arm 53 fixed to the input gear 63 is swingable within a range in which the toothless portion 63*a* of the gear 63 opposes the input gear 56. Other first arms 53 are swingable in the respective through holes 102 within a range in which the respective movable shafts 54 can move. The first arms 53 are urged rearward by the urging force of the respective coil springs. Therefore, the positioning bosses 43 of the respective LED heads 18 are pressed against the lower ends of the respective positioning grooves 42, and the four LED heads 18 are positioned at certain positions with respect to the respective photoconductor drums 8.

The printer 100 illustrated in FIG. 4 and FIG. 5 can obtain similar advantages of the printer illustrated in FIG. 1 and FIG. 2.

In this exemplary embodiment, the gear 63 meshing with the input gear 56 is the partially toothless gear, but it is not limited thereto, and a sector gear may be applied to the gear 63.

10. Third Exemplary Embodiment

Figure 6:
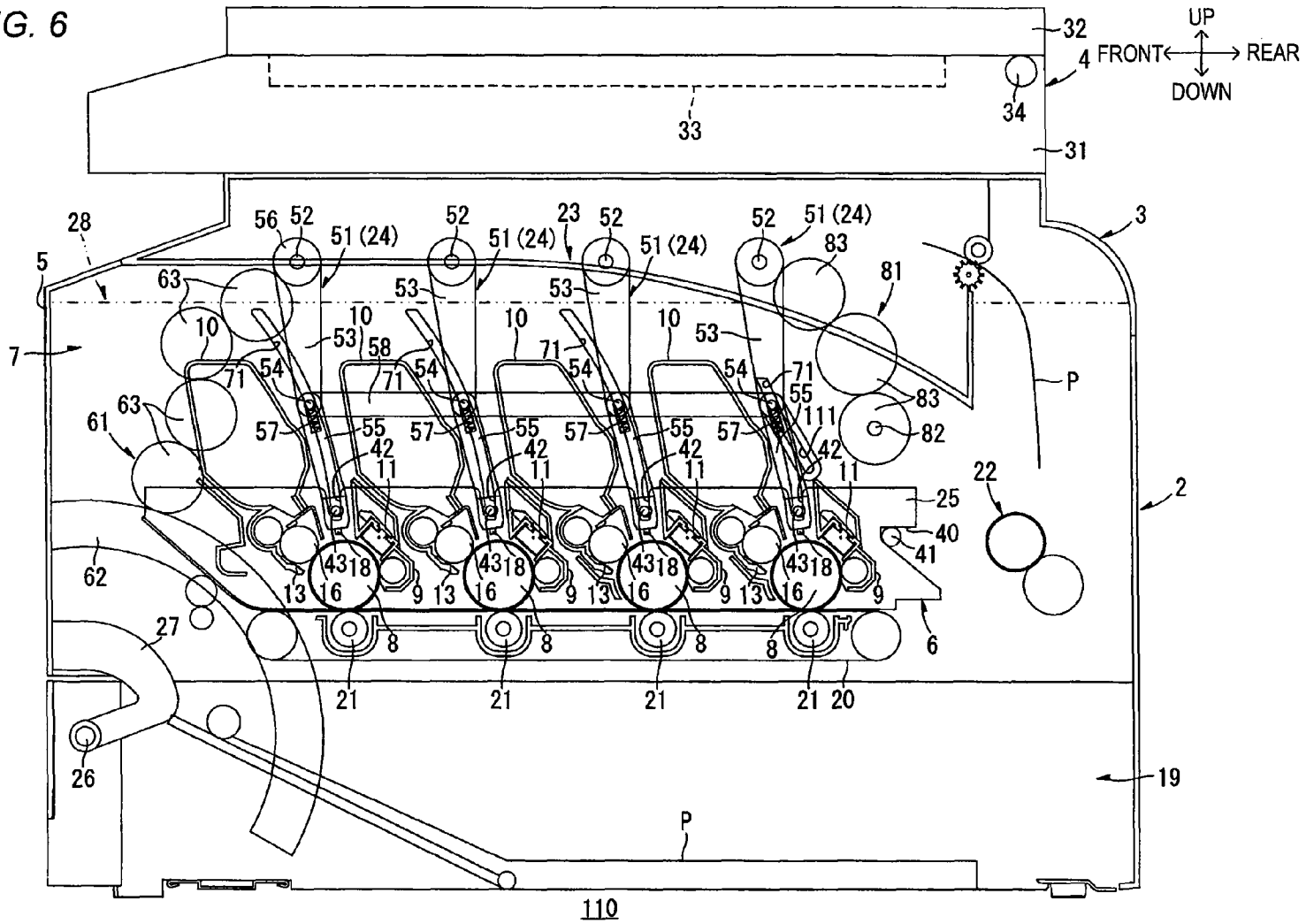
FIG. 6 is a side sectional view illustrating a printer according to a third exemplary embodiment.
Figure 7:
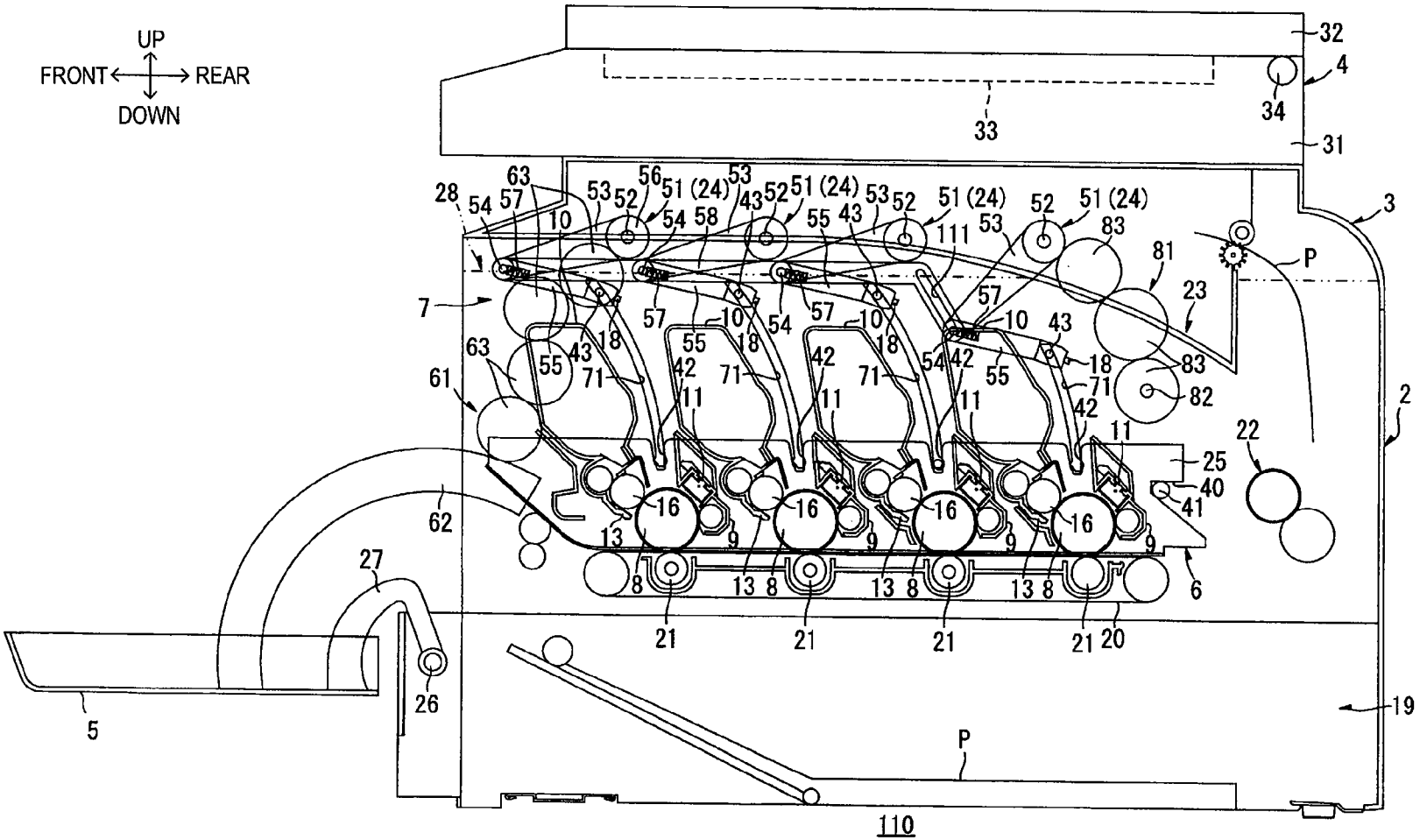
FIG. 7 is a side sectional view of the printer shown in FIG. 6 in a state in which a cover is opened.

FIG. 6 is a side sectional view illustrating a printer according to a third exemplary embodiment, and FIG. 7 is a side sectional view of the printer shown in FIG. 6 in a state in which a cover is opened. In FIG. 6 and FIG. 7, similar or identical elements in connection with FIG. 1 and FIG. 2 are denoted by identical reference symbols. Further, the following description relating to FIG. 6 and FIG. 7 is given around a different configuration than that of FIG. 1 and FIG. 2, and the description in connection with the similar and identical elements is omitted.

In the printer 110 illustrated in FIG. 6 and FIG. 7, the rear end portion of each of the left and right connection members 58 extends in a rear and lower direction. Specifically, the rear end portion of each of the connection members 58 extends in a direction opposite to a direction in which the connection members 58 move when each of the LED units 24 changes its posture from the exposure posture to the retracted posture. In the portion of each of the connection members 58 which extends in the rear and lower direction (i.e., the bent portion of the connection member 58), an elongated hole 111 extending along the bent portion. The movable shafts 54 of the rearmost left and right moving mechanisms 51 are slidably inserted in the respective elongated holes 111 of the left and right connection members 58.

When the front cover 5 is closed and the LED units 24 are in the exposure posture, the movable shafts 54 of the rearmost left and right moving mechanisms 51 is positioned at an upper end portion of the respective elongated holes 111. When the front cover 5 is opened, as the operation for opening the cover 5, the left and right connection members 58 move in a front and upper direction. At this time, in each of left and right sides, the front three movable shafts 54 move in the front and upper direction as the respective connection members 58 moves. On the other hand, the rearmost right and left movable shafts 54 keeps its absolute position unchanged and relatively move in the elongated hole 111 toward the lower end portion of the elongated hole 111. Therefore, the front three LED heads 18 are raised upward, and the rearmost LED head 18 does not move from a position closest to the photoconductor drum 8.

After the rearmost left and right movable shafts 54 are positioned at the lower end portions of the respective elongated holes 111, when the left and right connection members 58 further move, the rearmost left and right movable shafts 54 move in the front and upper direction, and the rearmost LED head 18 is raised upward later as compared with the front three LED heads 18. Therefore, the moving distance of the rearmost LED head 18 relative to the photoconductor drum 8 is smaller than that of other LED heads 18.

As shown in FIG. 7, when the front cover 5 is completely opened, the rearmost LED unit 24 overlaps with the developer cartridge 10 in the front and rear directions. However, the LED head 18 of the rearmost LED unit 24 is positioned at an upper portion than the upper ends of the side plates 25, which allows the rearmost LED unit 24 is separated from the mount/removal path of the drum unit 6, the drum unit 6 can be mounted and removed from the main body 2 without interfering with the LED units 24.

As described above, the rearmost LED head 18 positioned farthest from the opening 7 moves a distance relative to the photoconductor drum 8 shorter than that of other LED heads 18. Accordingly, a space required for retracting the rearmost LED head 18 from the photoconductor drum 8 can be made small. Therefore, the size of the image forming apparatus can be reduced for the space. Alternatively, for example, other members can be provided in the space, thereby a space in the main body 2 can be effectively used.

11. Modifications

For example, in each of the above-described exemplary embodiments, the synchronism mechanism 81 may be omitted. Instead, an input gear 56 may be provided at the frontmost left moving mechanism 51, and a power transmission mechanism 61 may be provided between this input gear 56 and the front cover 5.

The connection member 58 may be omitted. Instead, the gear tooth integrally rotating with the fixed shaft 52 may be provided, and a gear train configured to transmit the power between the fixed shaft 52 arranged in the front and rear directions may be provided.

In the printer 100 illustrated in FIG. 4 and FIG. 5, the coil springs 101 are connected to the respective first arms 53. However, the number of the coil spring 101 may be at least one, and the coil spring 101 may be connected to any one of the first arm 53. In this case, the movable shaft 54 is inserted to the connection member 58 without looseness. Accordingly, when the first arm 53 connected to the coil spring 101 is urged, the urging force is transmitted to other first arms 53 via the connection member 58.

In the above-described exemplary embodiments, the LED head 18 including a plurality of LEDs is illustrated as an example of an exposure member (an exposure head). However, the exposure member (the exposure head) is not limited to the LED head 18, and other configuration including a plurality of light emitting portions may be adopted. The plurality of light emitting portions may be configured by one light emitting element. For example, a backlight such as a fluorescent lamp may be provided as a light emitting element, and liquid crystals or optical shutters of PLZT elements arranged along a line extending in the left and right directions may be provided outside the backlight. That is, the combination of one light emitting element and one line of the optical shutters can configure a plurality of light emitting portions arrayed along a line. The light emitting portions may be arrayed in a plurality of lines instead of one line in the left and right directions. Further, the light emitting element is not limited to an LED but may be an electroluminescence element (EL element) and fluorescent material.

The invention claimed is:

1. An image forming apparatus comprising:

a main body having an opening;

a cover configured to move between a first position where the cover opens the opening and a second position where the cover closes the opening;

a plurality of photoconductors arrayed in a predetermined direction;

a plurality of exposure members provided in one to one correspondence with the plurality of photoconductors, each of the plurality of exposure members configured to expose the corresponding photoconductor and configured to move between a third position and a fourth position where each of the plurality of exposure members at the fourth position is located farther from the corresponding photoconductor than each of the plurality of exposure members at the third position;

moving mechanisms provided in one to one correspondence with the plurality of exposure members, each of the moving mechanisms configured to move the corresponding exposure member between the third position and the fourth position; and a power transmission mechanism including a plurality of gears and configured to transmit power from the cover to the moving mechanisms such that movement of the cover from the second position to the first position causes each of the moving mechanisms to move the corresponding exposure member from the third position to the fourth position, wherein each of the plurality of exposure members tilts when moving from the third position to the fourth position.

2. The image forming apparatus according to claim 1, wherein the power transmission mechanism is configured to transmit power from the cover to the moving mechanisms such that movement of the cover from the first position to the second position causes each of the moving mechanisms to move the corresponding exposure member from the fourth position to the third position, wherein each of the plurality of exposure members tilts when each of the plurality of exposure members moves from the fourth position to the third position.

3. The image forming apparatus according to claim 1 further comprising a connection member, the moving mechanisms connected to each other by the connection member.

4. The image forming apparatus according to claim 3, wherein one of the moving mechanisms is configured to engage the power transmission mechanism.

5. The image forming apparatus according to claim 4, wherein said one of the moving mechanisms includes an input gear configured to engage the power transmission mechanism.

6. The image forming apparatus according to claim 1, wherein the power transmission mechanism includes a rack gear fixed to the cover.

7. The image forming apparatus according to claim 1 further comprising a plurality of guides provided in one to one correspondence with the plurality of exposure members, each of the plurality of guides configured to guide the movement of the corresponding exposure member between the third position and the fourth position.

8. The image forming apparatus according to claim 1, wherein the plurality of photoconductors is connected to each other, and is configured to move along the predetermined direction when the cover is at the first position.

9. The image forming apparatus according to claim 1, wherein each of the plurality of photoconductors is a drum.

10. The image forming apparatus according to claim 9, wherein the cover is disposed at one side of the main body in the predetermined direction.

11. The image forming apparatus according to claim 1 further comprising a plurality of casings for accommodating developer provided in one to one correspondence with the plurality of photoconductors, wherein the plurality of casings overlap with the plurality of exposure members when the cover is located at the second position and when viewed in the predetermined direction, and wherein the plurality of casings do not overlap with the plurality of exposure members when the cover is located at the first position and when viewed in the predetermined direction.

12. The image forming apparatus according to claim 1 further comprising:

a reading unit configured to read an image on a document; and a supporting member provided between the main body and the reading unit and supporting the reading unit, wherein a part of the moving mechanisms is disposed in the supporting member.

13. The image forming apparatus according to claim 12, wherein a part of the plurality of exposure members is located in the supporting member when the cover is located at the first position.

14. The image forming apparatus according to claim 12, wherein each of the moving mechanisms includes a first moving mechanism and a second moving mechanism, the first moving mechanism is provided at one side of the corresponding exposure member in a direction perpendicular to the predetermined direction, and the second moving mechanism is provided at another side of the corresponding exposure member in the direction perpendicular to the predetermined direction.

15. The image forming apparatus according to claim 1, wherein each of the plurality of exposure members includes a LED head.

16. The image forming apparatus according to claim 1, wherein each of moving mechanisms includes a first moving mechanism and a second moving mechanism, the first moving mechanism is provided at one side of the corresponding exposure member in a direction perpendicular to the predetermined direction, and the second moving mechanism is provided at another side of the corresponding exposure member in the direction perpendicular to the predetermined direction.

17. An image forming apparatus comprising:

a main body having an opening;

a cover configured to move between a first position where the cover opens the opening and a second position where the cover closes the opening;

a plurality of photoconductors arrayed in a predetermined direction;

a plurality of exposure members provided in one to one correspondence with the plurality of photoconductors, each of the plurality of exposure members configured to expose the corresponding photoconductor and configured to move between a third position and a fourth position where each of the plurality of exposure members at the fourth position is located farther from the corresponding photoconductor than each of the plurality of exposure members at the third position;

moving mechanisms provided in one to one correspondence with the plurality of exposure members, each of the moving mechanisms configured to move the corresponding exposure member between the third position and the fourth position;

a power transmission mechanism configured to transmit power from the cover to the moving mechanisms such that movement of the cover from the second position to the first position causes each of the moving mechanisms to move the corresponding exposure member from the third position to the fourth position; and a plurality of guides provided in one to one correspondence with the plurality of exposure members, each of the plurality of guides having substantially an arc-shape and configured to guide movement of the corresponding exposure member between the third position and the fourth position, wherein each of the plurality of exposure members tilts when moving from the third position to the fourth position.

18. The image forming apparatus according to claim 17, wherein the power transmission mechanism includes a plurality of gears.

19. An image forming apparatus comprising:

a main body having an opening;

a cover configured to move between a first position where the cover opens the opening and a second position where the cover closes the opening;

a plurality of photoconductors arrayed in a predetermined direction;

a plurality of exposure members provided in one to one correspondence with the plurality of photoconductors, each of the plurality of exposure members configured to expose the corresponding photoconductor and configured to move between a third position and a fourth position where each of the plurality of exposure members at the fourth position is located farther from the corresponding photoconductor than each of the plurality of exposure members at the third position;

moving mechanisms provided in one to one correspondence with the plurality of exposure members, each of the moving mechanisms configured to move the corresponding exposure member between the third position and the fourth position, each of the moving mechanisms including a first arm and a second arm that is rotatably connected to the first arm; and a power transmission mechanism configured to transmit power from the cover to the moving mechanisms such that movement of the cover from the second position to the first position causes each of the moving mechanisms to move the corresponding exposure member from the third position to the fourth position, wherein each of the plurality of exposure members tilts when moving from the third position to the fourth position.

20. The image forming apparatus according to claim 19, wherein the power transmission mechanism includes a plurality of gears.

* * * * *